US010933443B2

(12) United States Patent
Fritz et al.

(10) Patent No.: US 10,933,443 B2
(45) Date of Patent: Mar. 2, 2021

(54) PAINTING METHOD AND PAINTING FACILITY FOR PRODUCING A DECORATIVE COATING

(71) Applicant: Dürr Systems AG, Bietigheim-Bissingen (DE)

(72) Inventors: Hans-Georg Fritz, Ostfildern (DE); Benjamin Wöhr, Eibensbach/Güglingen (DE); Marcus Kleiner, Besigheim (DE); Timo Beyl, Besigheim (DE); Moritz Bubek, Ludwigsburg (DE); Jens Eichhorn, Bietigheim-Bissingen (DE); Udo Wolf, Lauffen (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 101 days.

(21) Appl. No.: 15/323,806

(22) PCT Filed: Jul. 3, 2015

(86) PCT No.: PCT/EP2015/001366
§ 371 (c)(1),
(2) Date: Jan. 4, 2017

(87) PCT Pub. No.: WO2016/000826
PCT Pub. Date: Jan. 7, 2016

(65) Prior Publication Data

US 2017/0182516 A1 Jun. 29, 2017

(30) Foreign Application Priority Data

Jul. 4, 2014 (DE) ..... 10 2014 009 945.8

(51) Int. Cl.
*B05D 7/00* (2006.01)
*B05D 5/06* (2006.01)
(Continued)

(52) U.S. Cl.
CPC ..... *B05D 7/574* (2013.01); *B05D 3/0254* (2013.01); *B05D 3/0263* (2013.01);
(Continued)

(58) Field of Classification Search
CPC .... B05D 7/574; B05D 3/0254; B05D 3/0406; B05D 3/065; B05D 5/06; B05D 7/534;
(Continued)

(56) References Cited

U.S. PATENT DOCUMENTS 3,941,116 A * 3/1976 Placek ..... F24C 3/14 126/92 B
6,151,798 A * 11/2000 Petersen ..... B01D 1/18 34/218
(Continued)

FOREIGN PATENT DOCUMENTS

DE 3806257 A1 8/1989
DE 10141413 A1 3/2003
(Continued)

OTHER PUBLICATIONS

International Search Report and Written Opinion for PCT/EP2015/001366 dated Jan. 14, 2016 (with English translation; 35 pages).

*Primary Examiner* — James M Mellott
(74) *Attorney, Agent, or Firm* — Bejin Bieneman PLC

(57) ABSTRACT

A method for painting a component, in particular for painting a motor vehicle body component, with a decorative layer is provided. The decorative layer may be a decorative strip, a graphic element, a contrast surface or a pattern. The method includes applying a base coat layer, applying a decorative layer, which is within a decorative region with a limited surface area, to the component, and drying a limited drying region of the component, which drying region comprises at least part of the decorative region.

18 Claims, 17 Drawing Sheets

(51) Int. Cl.

| | |
|---|---|
| ***B05D 3/02*** | (2006.01) |
| ***B01D 3/04*** | (2006.01) |
| ***B05D 3/06*** | (2006.01) |
| ***B05B 13/04*** | (2006.01) |
| ***B05D 3/04*** | (2006.01) |

(52) U.S. Cl.
CPC ..... *B05D 3/0406* (2013.01); *B05D 3/065* (2013.01); *B05D 5/06* (2013.01); *B05D 7/534* (2013.01); *B05D 7/544* (2013.01); *B05D 7/546* (2013.01); *B05B 13/0452* (2013.01)

(58) Field of Classification Search
CPC ..... B05D 7/544; B05D 7/546; B05D 3/0263; B05B 13/0452
See application file for complete search history.

(56) References Cited

U.S. PATENT DOCUMENTS

| | | | | |
|---|---|---|---|---|
| 2002/0038521 | A1* | 4/2002 | Speck | B05D 3/0406 34/474 |
| 2003/0163932 | A1 | 9/2003 | Samekawa et al. | |
| 2007/0056184 | A1 | 3/2007 | Samekawa et al. | |
| 2009/0257070 | A1* | 10/2009 | Baird | B41J 3/4073 358/1.5 |
| 2009/0317629 | A1* | 12/2009 | Wegner | C09D 4/00 428/336 |
| 2010/0086669 | A1* | 4/2010 | Kuhlenschmidt | B05D 3/0263 427/8 |
| 2010/0203261 | A1 | 8/2010 | Kirk | |
| 2010/0251963 | A1 | 10/2010 | Herre et al. | |
| 2010/0304039 | A1* | 12/2010 | Bausen | B05B 16/20 427/488 |
| 2010/0319618 | A1* | 12/2010 | Bausen | B64F 5/10 118/697 |
| 2013/0224398 | A1 | 8/2013 | Vidal | |
| 2014/0063096 | A1* | 3/2014 | Pitz | B05C 11/1005 347/9 |
| 2015/0045493 | A1* | 2/2015 | Schwalm | C09D 175/16 524/500 |
| 2015/0375239 | A1 | 12/2015 | Herre et al. | |
| 2015/0375241 | A1 | 12/2015 | Wohr et al. | |
| 2015/0375258 | A1 | 12/2015 | Fritz et al. | |
| 2016/0001322 | A1 | 1/2016 | Fritz et al. | |

FOREIGN PATENT DOCUMENTS

| | | | |
|---|---|---|---|
| DE | 10261298 | A1 | 7/2003 |
| DE | 10312381 | A1 | 9/2004 |
| DE | 202007008852 | U1 | 10/2007 |
| DE | 202008008428 | U1 | 11/2009 |
| DE | 102010050704 | A1 | 5/2012 |
| DE | 102013002411.0 | A1 | 8/2014 |
| DE | 102013002412.9 | A1 | 8/2014 |
| DE | 102013002413.7 | A1 | 8/2014 |
| DE | 102013002433.1 | A1 | 8/2014 |
| DE | 102011117666 | B4 | 1/2019 |
| EP | 1518609 | A1 | 3/2005 |
| FR | 2961718 | A1 | 12/2011 |
| JP | 2004066042 | A | 3/2004 |
| JP | 2006021138 | A | 1/2006 |
| JP | 2006150206 | A | 6/2006 |
| JP | 2008006438 | A | 1/2008 |
| JP | 2008531243 | A | 8/2008 |
| JP | 2008246415 | A | 10/2008 |
| JP | 2011025244 | A | 2/2011 |
| JP | 2014050832 | A | 3/2014 |
| JP | 2014114995 | A | 6/2014 |
| WO | 2009156388 | A2 | 12/2009 |
| WO | 2010127738 | A1 | 11/2010 |
| WO | 2012176529 | A1 | 12/2012 |
| WO | 2013143659 | A1 | 10/2013 |

* cited by examiner

PAINTING METHOD AND PAINTING FACILITY FOR PRODUCING A DECORATIVE COATING

CROSS-REFERENCE TO RELATED APPLICATIONS

This application is a national stage of, and claims priority to, Patent Cooperation Treaty Application No. PCT/EP2015/001366, filed on Jul. 3, 2015, which claims priority to German Application No. DE 10 2014 009 945.8 filed on Jul. 4, 2014, each of which applications are hereby incorporated herein by reference in their entireties.

BACKGROUND

The present disclosure relates to a painting method and a painting facility for painting a component with a decorative layer, in particular for painting a motor vehicle bodywork component.

In the painting of motor vehicle bodywork components, there sometimes exists the desire for a multi-coloured paint coating, wherein the motor vehicle bodywork component is provided with a decorative layer (e.g. decorative stripes, designer stripe, pattern, graphic or contrast surface).

One possibility for such a decorative coating lies therein that corresponding films are affixed onto the base coat or onto the clear coat, wherein such films can also be over-coated with a clear coat.

Another possibility for realizing such a decorative coating lies therein that following the application and baking of the clear coat, the desired decorative layer is shaped with masking, wherein the free surface is then painted automatically or by hand. Following this application of the decorative layer, a further clear coat layer can then be applied onto the decorative layer.

In a few exceptional cases (e.g. for luxury limousines), decorative stripes are applied by hand with a brush, although this is not suitable for mass production.

If the decorative layer consists of a contrast surface with a differing colour, then the motor vehicle bodywork can be moved twice in succession through the same paint line or through two separate lines, wherein base coat and clear coat are applied respectively. Herein, in each case, the partial regions of the motor vehicle bodywork which are not to be coated are masked.

In known painting methods for a decorative coating, the base coat and clear coat layer serving as a substrate for the decorative layer can be intermediate-dried and baked, wherein the intermediate drying and the baking would extend over the entire component surface, which would be associated with a correspondingly high expenditure of energy and time.

The development of a painting method which applies coating agents or paints with sharp edges and over-spray-free without further auxiliary agents (DE 10 2013 002 413.7, DE 10 2013 002 412.9, DE 10 2013 002 411.0, DE 10 2013 002 433.1) enables the manufacturing of decorative layers, patterns or contrast surfaces without masking. With such a method, the decorative layer, the pattern or the contrast paint can be applied, for example, directly onto a base coat. However, for this purpose (at least for water-based base coats), pre-drying thereof is necessary. According to the prior art, for this purpose, the entire coating object would be conveyed through a convection dryer. Before the application of the clear coat, the content of volatile constituents in the decorative layer, pattern layer or contrast layer is reduced so far that no faults arise in the clear coat layer. According to the prior art, this means a renewed passage of the complete component through a dryer with subsequent cooling. This process requires a high energy input. According to the prior art, the overspray-free painting method would thereby only enable savings through the lack of a need for masking materials.

From DE 38 06 257 A1, a painting facility for painting motor vehicle bodyworks is known wherein an infrared radiator is arranged laterally adjoining the painting line and dries the sill region of the motor vehicle bodyworks in order to be able to apply a decorative layer on the sill. This known painting facility is, however, only suitable for decorative coating in the sill region.

Reference is also made, with regard to the prior art, to DE 20 2008 008 428 U1 and DE 20 2007 008 852 U1.

SUMMARY

The painting method according to the present disclosure provides initially that at least one paint layer which can then serve as the basis for the decorative layer is applied to the component.

In some implementations, this paint layer is a base coat layer that is known per se from the prior art and therefore need not be described in detail. It should be understood that, e.g., the paint layer of the present disclosure is typically not the lowest paint layer, which is applied to the component. In a typical multilayer paint for painting motor vehicle bodywork components, further paint layers are situated under this paint layer, for example, a cathodic dip coating (KTL) or a filling layer. It should also be understood that the paint layer of the present disclosure is not restricted to a wet paint. Rather, e.g., the paint layer in the context of the present disclosure can consist of powdered paint.

Furthermore, the painting method according to the present disclosure provides that an areally delimited—i.e. defined across an area—decorative layer (e.g. a decorative stripe, graphic, contrast surface or pattern) is applied to the component. The decorative layer is herein applied to the paint layer. In some implementations, the decorative layer is applied directly onto the paint layer, i.e. without a further intermediate layer. In other implementations, the decorative layer is applied indirectly onto the paint layer, i.e. with a further layer arranged therebetween.

With regard to the application of the decorative layer, reference should also be made to the aforementioned patent application DE 10 2013 002 433.1, so that the content of this patent application is fully incorporated within the present description.

The application of the decorative layer takes place with a suitable method which is able to apply a coating agent with sharp edges and overspray-free, as described, for example, in the patent application DE 10 2013 002 412.9 also mentioned above.

The applicator used according to the present disclosure for applying the paint may be one of known devices including, e.g., atomisers, print heads, nozzle arrangements or the like. In particular, however, it can involve a device which is suitable for the painting method mentioned above which applies painting or other coating agents with sharp edges and overspray-free without further aids.

The decorative layer of the present disclosure is not restricted to the aforementioned decorative design or decor stripes. Rather the decorative layer in some implementations of the present disclosure also comprises graphics, images and the like. A further example of a decorative layer is the painting of a partial area (e.g. a roof strut or a roof area of a motor vehicle bodywork) which is to be painted in a colour different from the remaining motor vehicle bodywork. The expression decorative layer in the present disclosure therefore covers any partial areas of a component surface which are to be coated with a different coating agent (e.g. in another colour tone or in another level of glossiness) from the remainder of the component surface. Furthermore, the phrase a partial area of the component surface used in the context of the expression decorative layer of the present disclosure means that the decorative layer covers only a partial area of the component surface, i.e. not the whole component surface. According to the principles of the present disclosure, in some exemplary embodiments, the decorative layer is not areally continuous, but covers the component surface only at the respective decorative details (e.g. lines).

Furthermore, the painting method according to the present disclosure provides that the component is dried in order to reduce the content of volatile constituents in the paint layer or in the decorative layer and to bring it below the residual moisture level necessary for the further painting process. For example, the residual moisture in typical aqueous paint systems following the intermediate drying lies, in some implementations, between 5% and 20%, and, in some such implementations, between 8% and 15%. The residual moisture in paint systems based on organic solvents can differ significantly therefrom, although this usually plays a subordinate role since, due to the organic solvents, the evaporation is so rapid that no process problems (e.g. bubbles, pinholes and dulling) occur, such as may occur due to other solvents remaining in the film.

The painting method according to the present disclosure further provides that the component is dried only in a limited area within a particular drying region which does not comprise the whole component surface, wherein the drying region at least partially comprises the decorative region. The drying step provided according to the present disclosure thus has a significantly lower time and energy requirement since it is not the entire component surface that is dried, but only the drying region of limited area.

Furthermore, the present disclosure provides that the limited drying region is moved over the component surface. For example, for this purpose a multi-axis drying robot which moves a drying unit over the component surface in order to dry the component surface at the respective correct site can be used.

The painting method according to the present disclosure is herein not restricted to a particular paint type (for example, water-based, solvent-containing, UV-curing).

In one implementation of the painting method according to the present disclosure, the paint layer is dried over its whole component surface before the application of the decorative layer. Subsequently, the limited area decorative layer is applied to the dried paint layer. Finally, the decorative layer is then dried, wherein this drying of the decorative layer takes place in a limited area within the drying region and does not cover the whole component surface. In this implementation of the present disclosure, the limited area drying of the decorative layer may result in saving of time and energy.

In another implementation of the painting method according to the present disclosure, the paint layer is dried only in a limited area within the drying region before the application of the decorative layer, wherein the limited area drying region at least partially covers the later decorative region. Following this limited area drying of the paint layer, the decorative layer is then applied onto the paint layer in the decorative region. In this implementation of the present disclosure, the saving of time and energy may result from the limited area drying of the decorative layer, since the paint layer is not dried over the whole component surface, but only within the drying region.

In one exemplary implementation of the painting method according to the present disclosure, the drying region and the decorative region coincide areally, i.e. each point of the drying region also lies within the decorative region and vice versa.

In some implementations, the drying region entirely encompasses the decorative region and is larger than the decorative region.

Furthermore, in some implementations, the decorative region is larger than the drying region and completely encompasses the drying region, wherein the drying region merely covers the peripheral edge of the decorative region. The drying at the peripheral edge of the decorative region is important so that the peripheral edge of the decorative region does not run, which would be visually unacceptable.

Furthermore, in some implementations the decorative region is larger than the drying region, wherein the drying region covers the peripheral edge of the decorative region and extends outwardly beyond the peripheral edge of the decorative region.

In the context of the present disclosure, different drying types are distinguished, specifically, first, the unlimited area drying of the component over its entire component surface. Second, another drying type is the limited area drying of the component within the drying region as provided according to the present disclosure. These two different drying types lead typically to a particular residual moisture level after the drying.

In an implementation of the present disclosure, the residual moisture level achieved with the limited area drying is essentially the same as the residual moisture level achieved with the areally unlimited conventional drying.

In some implementations, the residual moisture level achieved in the limited area drying according to the principles of the present disclosure is lower than the residual moisture level achieved in the unlimited area drying.

Finally, in other implementations, the residual moisture level achieved in the limited area drying is higher than the residual moisture level achieved in the unlimited area drying.

In one exemplary implementation of the present disclosure, drying of the paint layer is limited (limited area drying) as only required for applying the decorative layer (characterised, for example, by even strength of the decorative layer, a good progression of the decorative layer, no mixing of the decorative paint with the base paint, no sinking of the decorative paint into the base paint). It should be understood that, according to the principles of the present disclosure, in limited area drying, the drying is insufficiently extensive to provide a residual moisture level to enable application of a clear coat layer onto the paint layer without difficulty.

In the context of the present disclosure, different drying methods can be used some of which are per se known from the prior art and therefore need not be described in detail.

For example, in some implementations, the drying can take place by irradiation of the component to be dried, with a radiation. The radiation is, for example, electromagnetic radiation, e.g. microwave radiation, infrared radiation or ultraviolet radiation, or bombardment with electrons. The electromagnetic radiation can be generated, for example, by LEDs (light-emitting diodes) OLEDs (organic light-emitting diodes), halogen incandescent lamps or carbon-infrared radiators.

For example, the electromagnetic radiation can be short-waved with a wavelength in the region of 0.8 μm to 1.2 μm. The radiation can, however, also be medium-wavelength radiation with a wavelength in the region of 1.2 μm to 4 μm. In other implementations, that the radiation is long-waved with a wavelength in the region of 4 μm to 10 μm. Finally, in other implementations, the radiation is microwave radiation which can have a wavelength, for example, in the order of a few cm (1-100 cm). According to the present disclosure, drying with UV may be utilized if the paints are suitable therefor.

The radiation source per se can also be sharply delimited and/or directed (for example, of the type of a laser) in order to irradiate and dry at least a part of the area to be dried.

In some implementations, the component is dried by air drying, for example, with cold air (air temperature from 0° C. to +40° C.), warm air (air temperature from +40° C. to +300° C.) and/or with dry air with a relative humidity of less than 20%, 10%, 5% or 1%.

Finally, some implementations of the present disclosure include negative pressure drying, wherein the component to be dried is subjected to a local negative pressure.

The aforementioned negative pressure drying can take place, for example, with a suction bell which is guided over the component surface to be dried and generates a locally delimited negative pressure.

In the drying described above by radiation or air, the limited area drying region can be masked by a shield so that the radiation or an air stream essentially only impacts upon the drying region.

Regarding the aforementioned air drying, it should be mentioned that an air stream can be directed through a diffuser onto the component surface to be dried, so that the air stream diffusely impacts upon the component surface to be dried. For example, the diffuser can comprise a wire mesh, porous sintered metal or porous sintered ceramic or can consist of porous sintered plastics.

According to the principles of the present disclosure, the radiation drying can be combined with air drying (cold, hot, dry) and/or with negative pressure drying.

Furthermore, the air stream for drying the component can be directed through at least one nozzle onto the component surface to be dried. In one implementation of the present disclosure, a plurality of nozzles are oriented parallel to one another and perpendicularly to the component surface to be dried. In other implementations, the nozzles are oriented parallel to one another and inclined to the component surface to be dried. Furthermore, in other implementations, the nozzles are oriented obliquely inwardly at the peripheral edge of the drying region and, in the centre of the drying region, substantially perpendicularly to the component surface to be dried.

It should be understood that the combination of obliquely and perpendicularly oriented nozzles is not restricted to the implementation described. Rather, a plurality of implementations of the present disclosure include both nozzle types are arranged in different ways on the drying unit. The nozzle exit can be round, oval or slit-shaped.

The nozzles can also be diffuse, i.e. arranged in many mutually different angles and not subject to any symmetry.

In an exemplary implementation of the present disclosure, the component can be dried with a drying unit which can emit, for example, air or radiation in order to dry the component. It is herein advantageous if the drying unit has a form which is adapted to the form of the component to be dried. For example, the drying unit can therefore have a planar, convex or concave form.

In one exemplary implementation of the present disclosure, the drying unit is moved together with the applicator along a painting path over the component, in particular with a multi-axis painting robot. In some such implementations, the drying unit dries the component, and the applicator applies the decorative layer.

In some such implementations, the drying unit is arranged in the path direction in front of the applicator, so that the paint layer is firstly dried by the drying unit, whereupon the subsequent applicator then applies the decorative layer onto the intermediate-dried paint layer.

In other such implementations, the drying unit is arranged behind the applicator in the path direction, so that on a movement, the applicator first applies the decorative layer and then the subsequent drying unit dries the previously applied decorative layer in a limited area.

In other implementations of the present disclosure, the drying and application of the decorative layer takes place sequentially on separate movement paths. For example, initially, a movement path of the drying unit takes place, wherein the drying unit then dries the paint layer in a limited area. Subsequently, a second movement path then takes place, wherein the applicator applies the decorative layer. In other such implementations, the decorative layer is first applied on the first movement path and then, on the subsequent second movement path, the drying unit dries the decorative layer.

The present disclosure includes variations in the sequence of steps of the painting method.

In one exemplary implementation of the present disclosure, first a base coat layer is applied to the component. The base coat layer is then intermediate-dried on the whole component surface, for example, with air drying with an air temperature of +60° C. to +80° C. Following this intermediate drying and subsequent cooling of the base coat layer, the decorative layer is then applied to the intermediate-dried base coat layer. Subsequently, a limited area drying of the decorative layer within the drying region then takes place, wherein the drying region at least partially encompasses the decorative region. Finally, a clear coat layer is applied to the base coat layer and the decorative layer.

In another exemplary implementation of the present disclosure, first a base coat layer is applied to the component. Subsequently, a limited area drying of the decorative layer of the base coat layer then takes place within the drying region, wherein the drying region encompasses the later decorative region. Thereafter, the decorative layer is applied to the limited area intermediate-dried base coat layer within the decorative region. In a next step, an intermediate drying of the base coat layer and of the decorative layer then takes place on the whole component surface, for example, with air drying with an air temperature of +60° C. to +80° C. Finally, a clear coat layer is then applied to the base coat layer and the decorative layer.

In a further exemplary implementation of the present disclosure, first a base coat layer is applied to the component. Subsequently, a limited area drying of the base coat layer then takes place within the drying region, wherein the drying region encompasses the later decorative region. Thereafter, the decorative layer is applied to the intermediate-dried base coat layer within the decorative region. In a further step, a limited area drying of the base coat layer and of the decorative layer then takes place within the drying region, wherein the drying region encompasses the decorative region. Finally, in another implementation of the present disclosure, a clear coat layer is applied to the base coat layer and the decorative layer.

A further exemplary implementation of the present disclosure provides first that a base coat layer is applied to the component. Subsequently, a limited area drying of the base coat layer then takes place within the drying region, wherein the drying region encompasses the later decorative region. In a further step, an application of the decorative layer onto the limited area intermediate-dried base coat layer within the decorative region then takes place. Finally, a clear coat layer is then applied to the base coat layer and the decorative layer.

According to another implementation of the present disclosure, it is provided, by contrast, that initially a base coat layer is applied to the component, wherein the base coat layer is then subjected to an intermediate drying over the whole component surface, for example, with air drying with an air temperature of +60° C. to +80° C. Subsequently, a clear coat layer is then applied to the intermediate-dried base coat layer. In a further step, it is then provided that the clear coat layer is dried in a limited area within the drying region, wherein the drying region encompasses the later decorative region. Thereafter, the decorative layer is then applied within the decorative region. Then, finally, a drying of the clear coat layer and of the decorative layer takes place on the entire component, in particular by air drying, for example, with an air temperature of +130° C. to +150° C. This drying of the clear coat layer and of the decorative layer is thus to be differentiated from the intermediate drying in the other implementations of the present disclosure described above, since the intermediate drying takes place with a lower air temperature of +60° C. to +80° C.

A further implementation of the present disclosure provides that first a base coat layer is applied to the component. Then subsequently, an intermediate drying of the base coat layer takes place on the whole component surface, for example, with air drying with an air temperature of +60° C. to +80° C. Then in a subsequent step, a clear coat layer is applied to the intermediate-dried base coat layer. In a next step, the clear coat layer is dried, specifically on the whole component surface, in particular, with air drying with an air temperature of +130° C. to +150° C. Thereafter, the decorative layer is then applied within the decorative region on the clear coat layer. Finally, a limited area drying of the decorative layer within the drying region then takes place, wherein the drying region encompasses the decorative region.

Furthermore, another exemplary implementation of the present disclosure is where, first, a base coat layer is applied to the component. Subsequently, a clear coat layer is then applied to the base coat layer, wherein the clear coat layer is applied without any intermediate drying, wet-on-wet onto the base coat layer. The clear coat layer and the base coat layer are then dried on the entire component, in particular by air drying, for example, with an air temperature of +130° C. to +150° C. Thereafter, the decorative layer is then applied within the decorative region. Finally, a limited area drying of the decorative layer within the drying region can then take place, wherein the drying region encompasses the decorative region.

A further implementation of the present disclosure provides, that first a base coat layer is applied to the component. In a further step, an application of the decorative layer then takes place. Subsequently, a limited area drying of the decorative paint layer takes place. Finally, a clear coat layer is then applied to the base coat layer and the decorative layer.

The different implementations of the present disclosure described above can also be combined with additional further steps which are inserted arranged before, after or between the above-described steps.

Finally, the present disclosure also includes a painting facility for applying a decorative coating. The painting facility according to the present disclosure has an application apparatus for applying a paint layer. This application apparatus can be, for example, a conventional painting robot with a rotary atomiser.

Furthermore, the painting facility according to the present disclosure has an application apparatus in order to apply the limited area decorative layer to the component. This application apparatus can be, for example, a conventional rotary atomiser, but in particular an applicator as described, for example, in DE 10 2013 002 413.7, DE 10 2013 002 412.9 and DE 10 2013 002 411.0, so that the content of these patent applications is fully incorporated within the present description.

Furthermore, the present disclosure also comprises a drying unit for drying the component to reduce the content of volatile constituents. The painting facility according to the present disclosure is further distinguished in that the drying apparatus is configured and operated so that the component is dried only in a limited area within a particular drying region, wherein the drying region at least partially comprises the decorative region.

Herein, the present disclosure provides that the drying unit is moved over the component surface. For example, for this purpose a multi-axis drying robot which moves a drying unit over the component surface in order to dry the component surface at the respective correct site can be used.

In one exemplary implementation of the present disclosure, it is provided that the drying unit and the application apparatus for applying the decorative layer are guided together with a multi-axis robot.

In other implementations, the drying unit and the application apparatus for applying the paint layer or the application apparatus for applying the decorative layer are guided by separate robots, respectively.

DRAWINGS

The present disclosure is described below in greater detail with reference to the drawings, in which:

FIGS. 1-7 each show an implementation of a painting method according to the present disclosure in the form of a flow diagram, respectively, FIGS. 8A-8E each show an implementation of a drying unit according to the present disclosure for drying the component, respectively, FIGS. 9A-9E each show a different cross-sectional view through a coated component with the drying region and the decorative region, respectively, FIG. 10 shows a schematic representation of a drying unit according to the present disclosure for radiative drying with a shield for masking the drying region, FIG. 11 shows a schematic representation to illustrate the spacing of the drying unit, FIGS. 12A-12E each show a schematic representation of a different implementation of a drying unit, respectively, FIG. 13 shows a schematic representation of a drying unit according to the present disclosure, FIGS. 14A-14E each show a different graphical representation of the reduction of the residual moisture level with the drying, respectively, FIGS. 15A-15D each show a different schematic representation of an for air drying unit, respectively, FIG. 16 shows a schematic representation of a robot with a drying unit and an applicator, and FIG. 17 shows a schematic representation of a robot for applying the decorative layer and a further robot for drying the component surface.

DESCRIPTION

FIGS. 1-7 show different implementations of a painting method for decorative coating, according to the principles of the present disclosure, each in the form of a flow diagram. These exemplary implementations differ essentially in the sequence of their steps. Therefore, first the individual steps of these implementations according to FIGS. 1-7 will be described.

In a step BC (BC: base coat), a base coat layer is applied to the component surface of the component to be coated (e.g. motor vehicle bodywork component). In some implementations, the base coat layer is single-layered and, in other implementations, there are two base coat layers (BC1+BC2). The base coat layer may be wet paint or powder paint. The base coat layer is, in some implementations, applied in a conventional manner, e.g., with a rotary atomiser or an air atomiser which is guided by a multi-axis painting robot.

In a step ZTR (intermediate drying), the entire component surface is then intermediate-dried. For example, this intermediate drying can take place with air drying, for example, with an air temperature of +60° C. to +80° C. It should be mentioned that, in each case, in the context of the intermediate drying, the entire component surface is dried, for which purpose, the component to be dried can be introduced, for example, into a drying chamber, as is known from the prior art.

In a step DC (DC: decor coat), a decorative layer (e.g. decorative stripe, graphic, contrast surface or pattern) is applied to the component, wherein the decorative layer is areally limited to a particular decorative region and does not extend over the entire component surface.

In a step PTR (partial drying), a limited area (partial) drying takes place within a drying region which at least partially encompasses the decorative layer. This limited area drying can take place, for example, with air drying or by irradiation of the component surface.

In a step CC (CC: clear coat), a clear coat layer is then applied. The clear coat layer may be single-layered or multi-layered. The clear coat may be a single-component clear coat or a two-component clear coat.

In the field of automobile serial-production painting, components are typically dried or baked with a suitable apparatus following the final painting step—including the application of a clear coat layer is described, provided air-drying lacquers (e.g. two-component lacquers) are not used.

Finally, some implementations also comprise a further step TR (drying) in which the entire component surface is completely dried. This drying takes place, for example, by air drying with a relatively high air temperature of +130° C. to +150° C. During the drying in the step TR, the air temperature is thus substantially higher than during the intermediate drying in the step ZTR.

The implementations shown in FIGS. 1-7 differ in the sequence of the above-described steps, as follows:

FIG. 1: BC→ZTR→DC→PTR→CC.

FIG. 2: BC→PTR→DC→ZTR→CC.

FIG. 3: BC→PTR→DC→PTR→CC.

FIG. 4: BC→PTR→DC→CC.

FIG. 5: BC→ZTR→CC→PTR→DC→TR.

FIG. 6: BC→ZTR→CC→TR→DC→PTR.

FIG. 7: BC→CC→ZTR→DC→PT.

FIGS. 8A-8E show different implementations of a drying unit 1 for drying a coating on a component 2, wherein the drying unit 1 can emit, for example, an air stream onto the component surface of the component 2.

The individual figures herein differ in the shaping of the component and the correspondingly adapted shaping of the drying unit. The drying unit 1, on one side, and the component 2, on the other, therefore have complementary matching forms.

Thus, the component 2 in FIG. 8A is planar, so that the drying unit 1 is also essentially planar.

In the implementation of the present disclosure according to FIG. 8B, the component 2 is convex, so that the drying unit 1 is formed correspondingly concave.

In the exemplary implementation according to FIG. 8C, however, the component 2 is concave, so that the drying unit 1 is formed correspondingly convex.

In the implementation according to FIG. 8D, the component 2 has a component edge projecting upwardly in the drawing, so that the drying unit 1 is formed correspondingly adapted.

Finally, the drying unit 1 in the exemplary implementation according to FIG. 8E has a projecting edge, which extends perpendicularly to the drawing plane.

FIGS. 9A-9E show different cross-sectional views of a component 2 with a base coat layer 3 and a decorative layer 4 applied onto the base coat layer 3 within a decorative region. The drawings also show schematically a drying region 5, wherein the base coat layer 3 is dried in a limited area within the drying region 5.

In the exemplary implementation according to FIG. 9A, the decorative region of the decorative layer 4 and the drying region 5 match one another exactly coincidingly.

In the exemplary implementation according to FIG. 9B, the drying region 5 is larger than the decorative region of the decorative layer 4 and fully encompasses the decorative region.

The exemplary implementation according to FIG. 9C, however, shows that the drying region 5 covers only part of the decorative region of the decorative layer 5, specifically the peripheral edge of the decorative layer 4.

The exemplary implementation according to FIG. 9D partially corresponds to the exemplary implementation according to FIG. 9A. However, the drying depth of the drying region 5 is herein less than in the exemplary implementation according to FIG. 9A.

The exemplary implementation according to FIG. 9E is also partially in accordance with the exemplary implementation according to FIG. 9A. However, the drying depth of the drying region 5 is herein larger and extends through the base coat layer 3 as far as the component 2.

FIG. 10 shows a schematic representation of a drying unit 1 according to the present disclosure, which dries the decorative layer 4 by irradiation, for example with infrared radiation.

Herein, a shield 6 is also shown which masks the component surface and only allows through the radiation serving for drying purposes in the region of the decorative layer 4, so that the drying unit 1 dries the component surface in a limited area within the decorative region.

Figure 1:
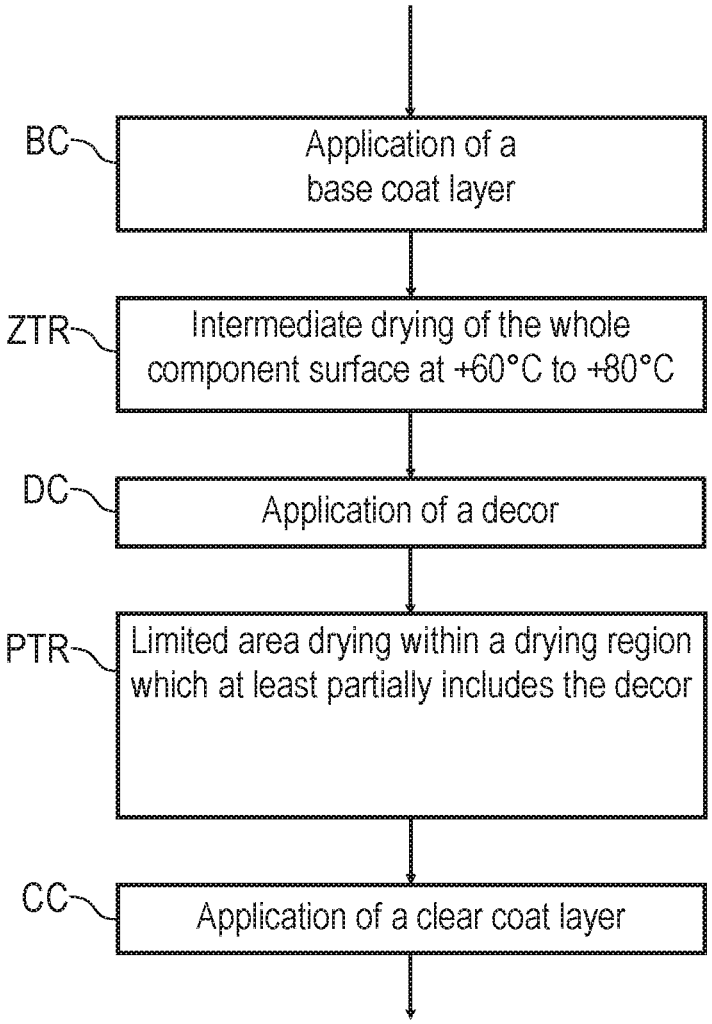
Figure 2:
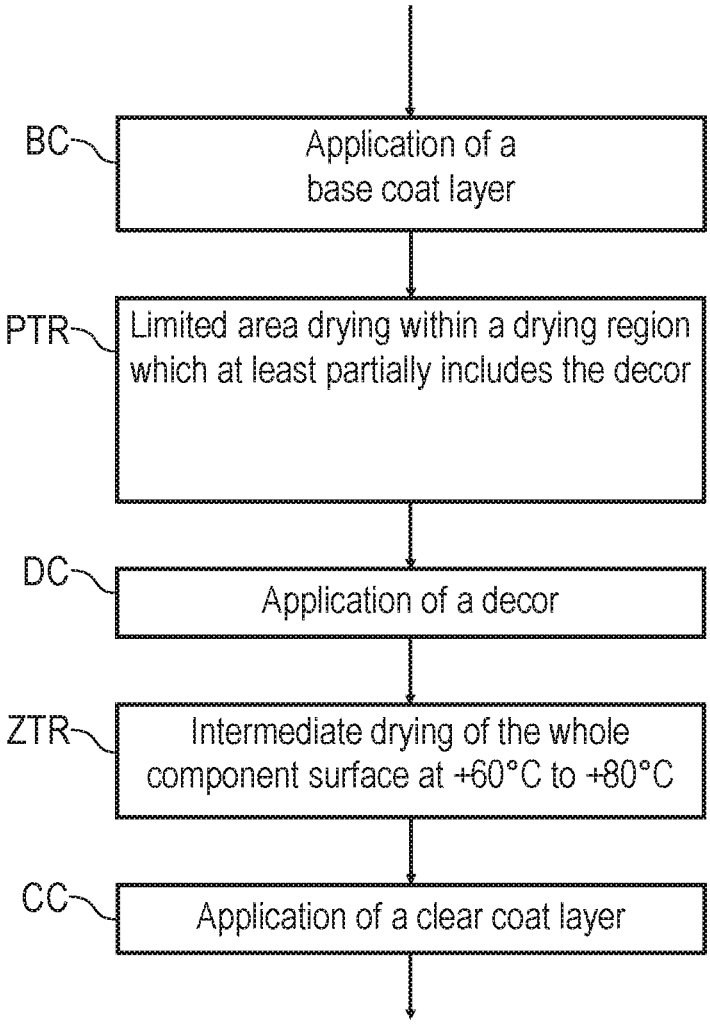
Figure 3:
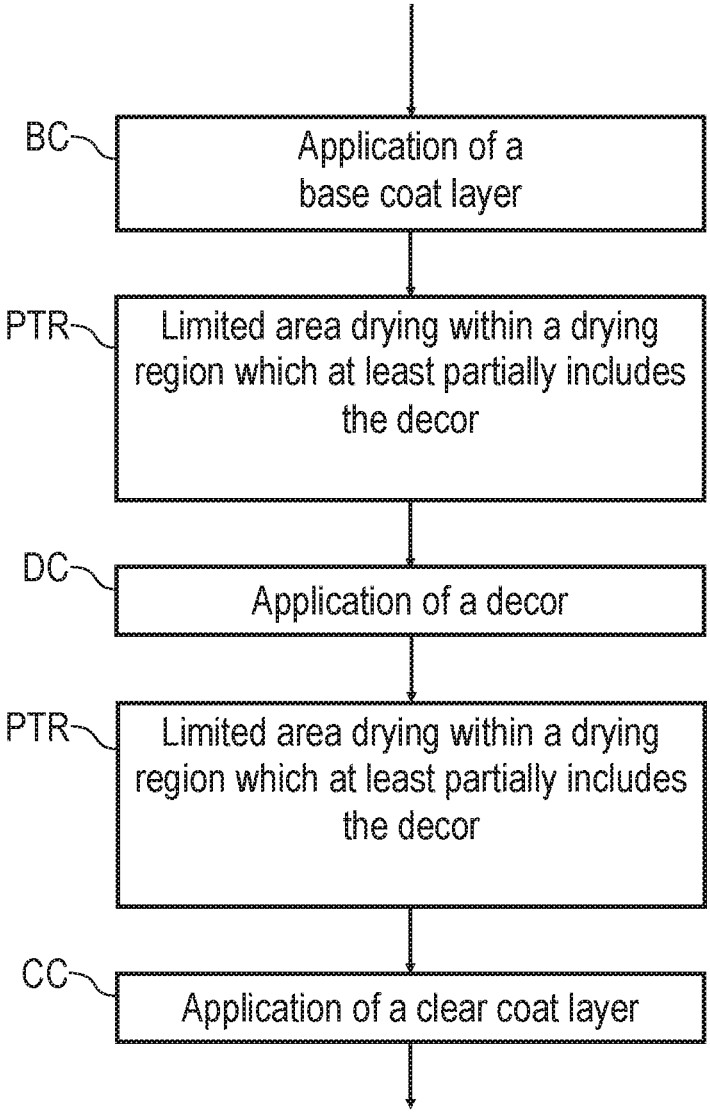
Figure 4:
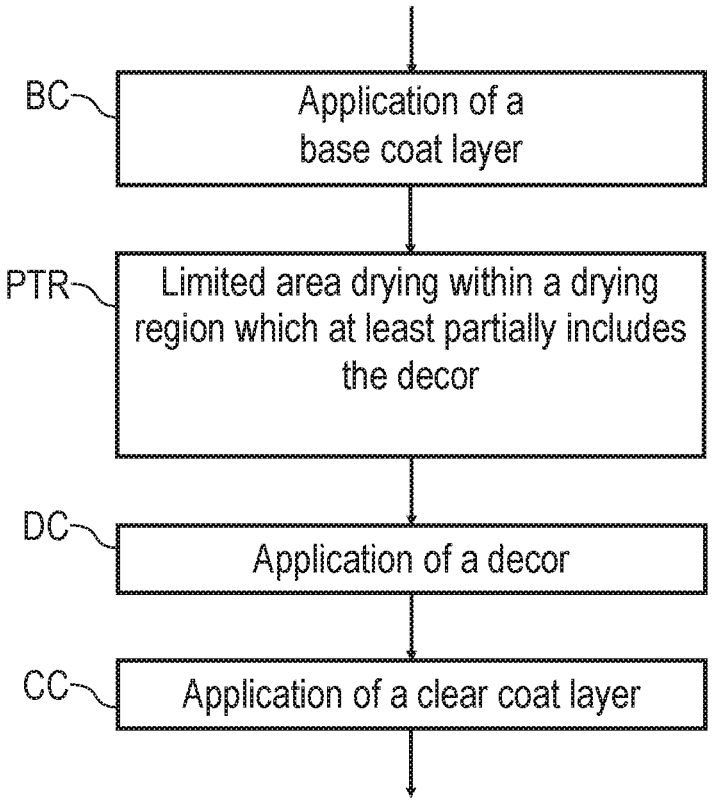
Figure 5:
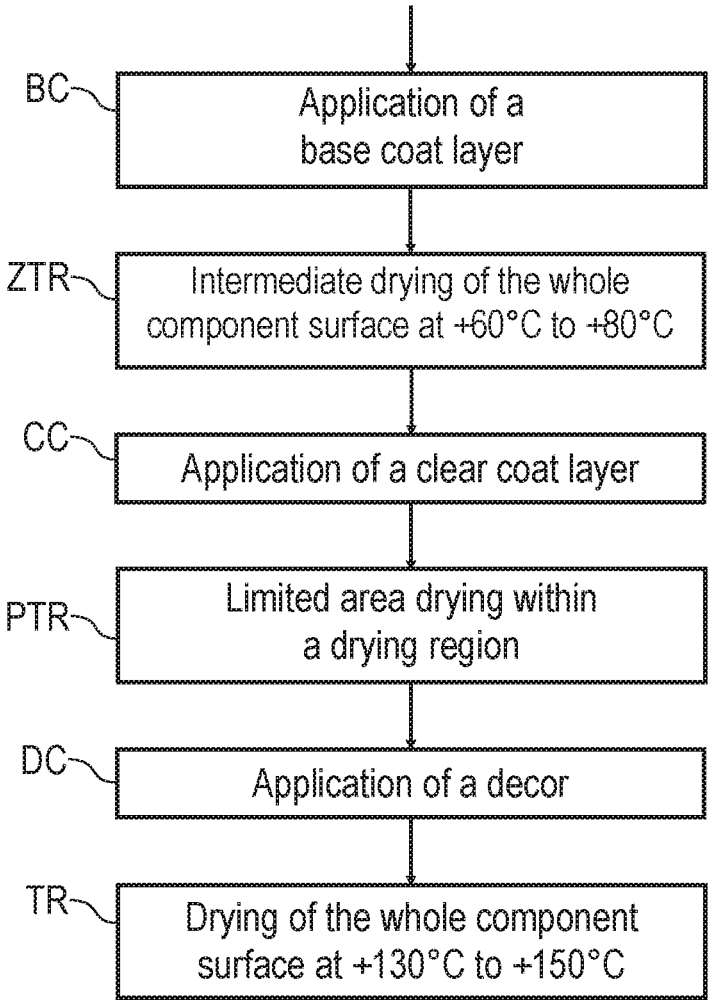
Figure 6:
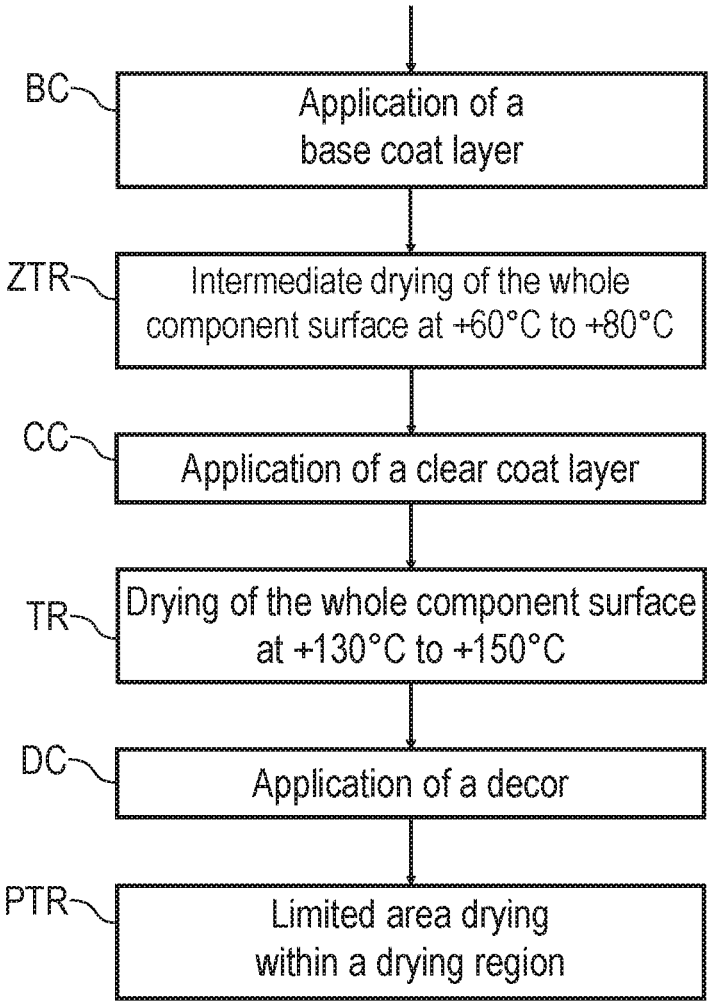
Figure 7:
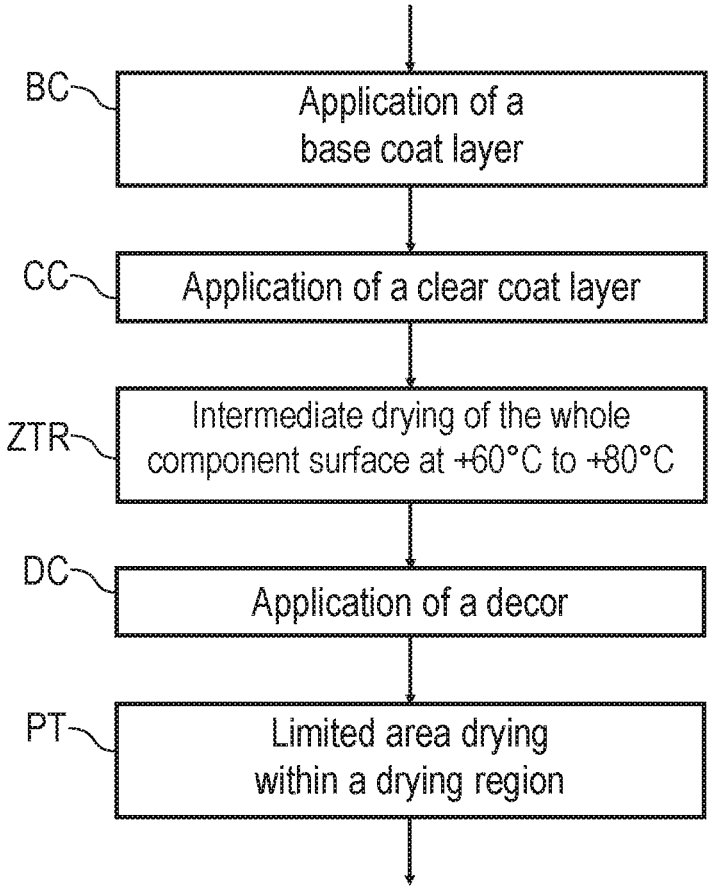
Figure 8A:
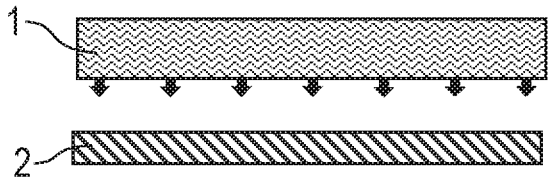
Figure 8B:
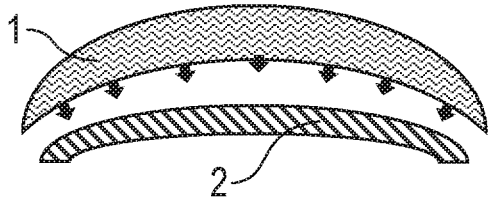
Figure 8C:
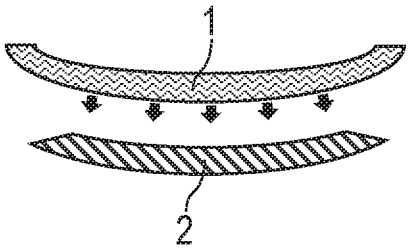
Figure 8D:
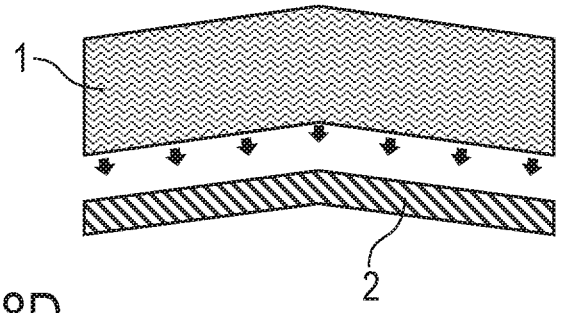
Figure 8E:
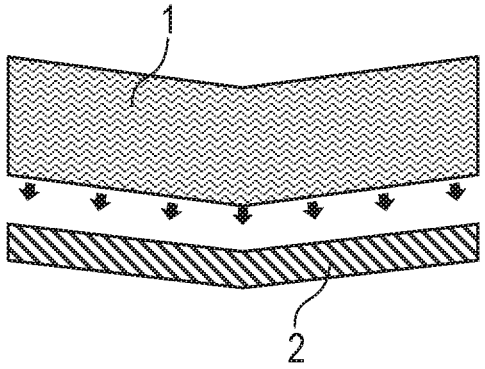
Figure 9A:
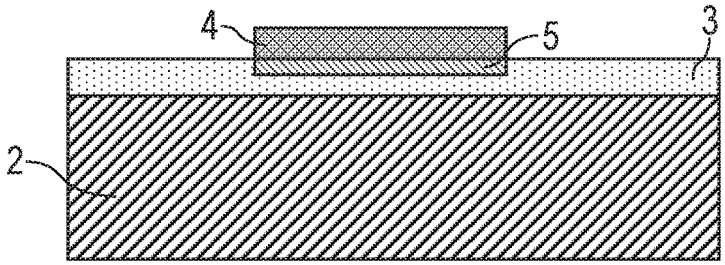
Figure 9B:
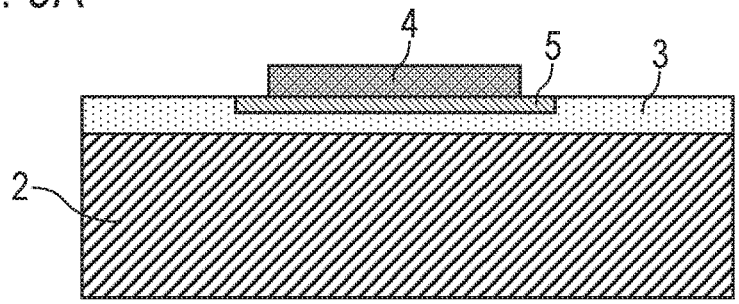
Figure 9C:
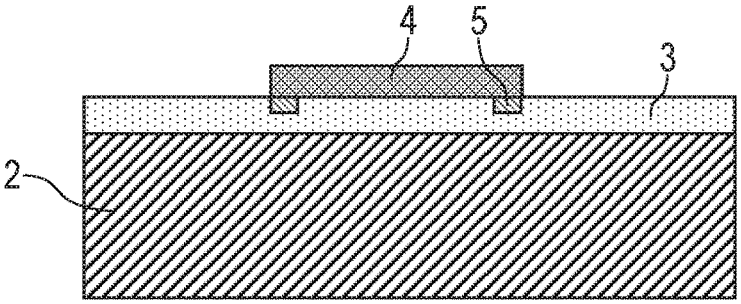
Figure 9D:
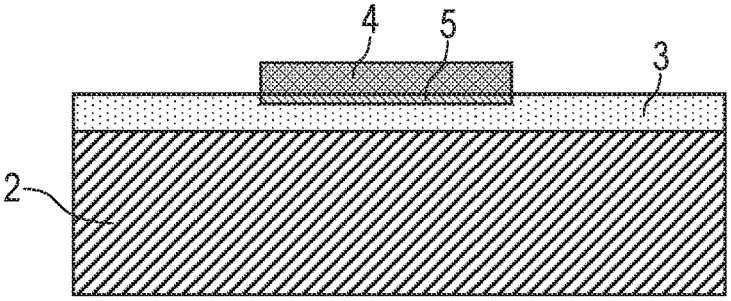
Figure 9E:
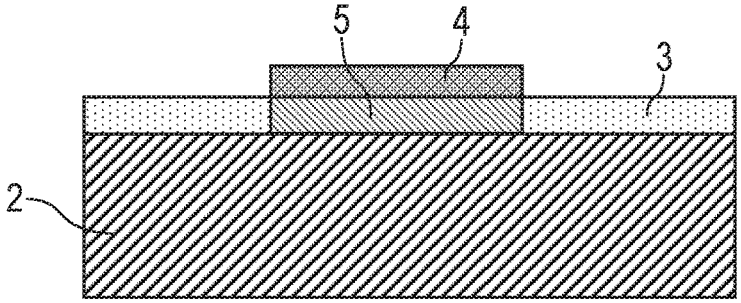
Figure 10:
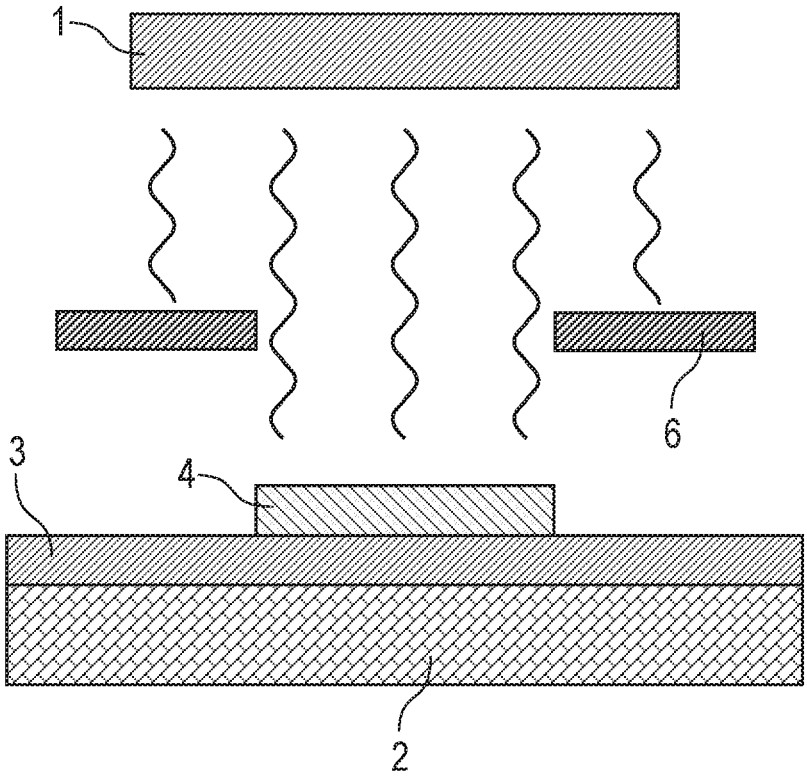
Figure 11:
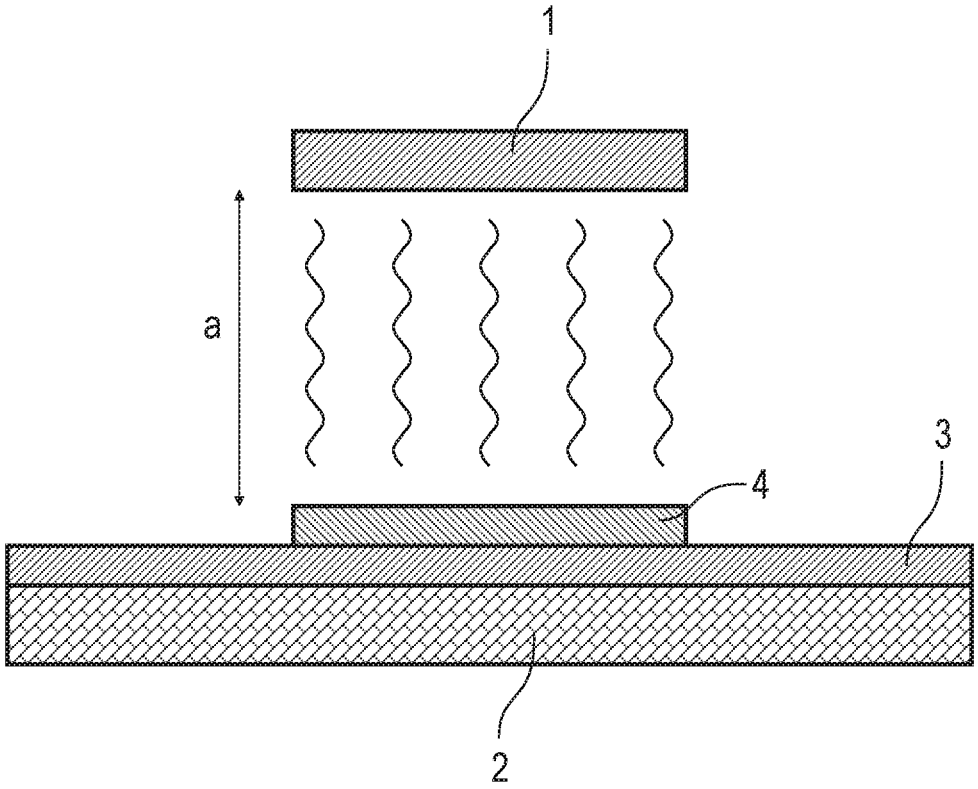
FIG. 11 shows a further implementation including a spacing a between the drying unit 1 and the component surface.
Figure 12A:
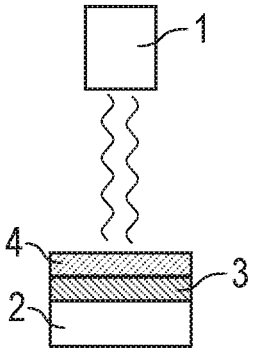
FIGS. 12A to 12E show different types of drying units 1.

In the exemplary implementation according to FIG. 12A, the drying unit 1 exclusively emits electromagnetic radiation (e.g. infrared radiation) for drying the component surface.

Figure 12B:
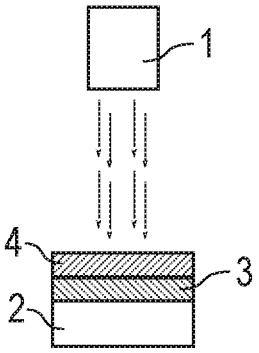

In the exemplary implementation according to FIG. 12B, the drying unit 1 exclusively emits an air stream for drying the component surface.

Figure 12C:
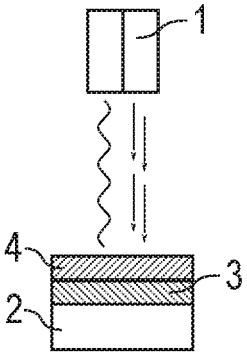

The exemplary implementation according to FIG. 12C combines a drying with an air stream and by electromagnetic radiation (e.g. infrared radiation).

Figure 12D:
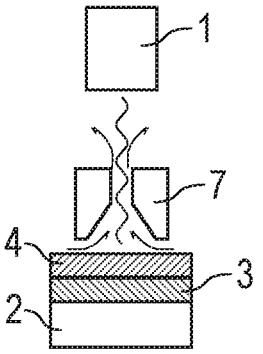

In the exemplary implementation according to FIG. 12D, the drying unit 1 additionally has a negative pressure bell 7 which is guided over the component surface in order to dry the component surface with negative pressure. Furthermore, the drying unit 1 herein also emits electromagnetic radiation (e.g. infrared radiation) to the component surface. This exemplary implementation also combines a negative pressure drying with a radiative drying.

Figure 12E:
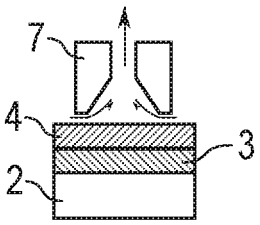

Finally, FIG. 12E shows a pure negative pressure drying.

Figure 13:
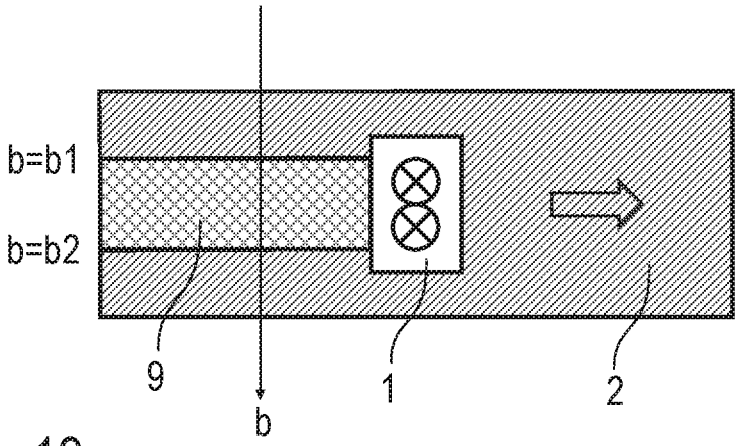

FIG. 13 shows a schematic plan view of a drying unit 1 according to the present disclosure for limited area drying of a component 2, wherein the drying unit 1 is transported in the arrow direction (in other cases, the component 2 could also be transported). The drying unit 1 is herein situated over the component 2 to be dried, so that a dried region 8 of restricted width is dried behind the drying unit 1.

FIGS. 14A-14E show different patterns of a residual moisture level F in the base coat layer 3 along the width b in FIG. 13. The values b=b1 and b=b2 herein mark the edges of the drying region 8 in FIG. 13. The value F1 signifies the residual moisture level which is achieved with the limited area drying according to the present disclosure. The value F2 however characterises the residual moisture level which is achieved with a conventional component drying, for example, in a drying chamber.

Figure 14A:
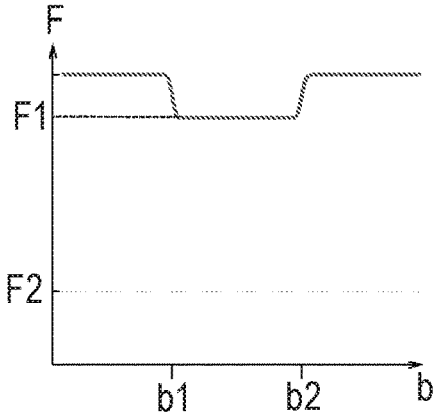

FIG. 14A shows a implementation of the present disclosure wherein the residual moisture level F1 achieved in the limited area drying is substantially higher than the residual moisture level F2 achieved in the conventional unlimited area drying. The residual moisture level F1 is typically too high for faultless application of a clear coat layer, although the residual moisture level F1 is sufficiently lower for the application of the decorative layer.

Figure 14B:
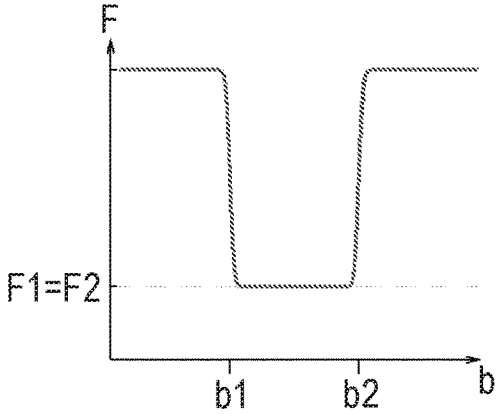

FIG. 14B shows a implementation of the present disclosure wherein the residual moisture level F1 achieved with the limited area drying is equal to the residual moisture level F2 achieved in the conventional unlimited area drying.

Figure 14C:
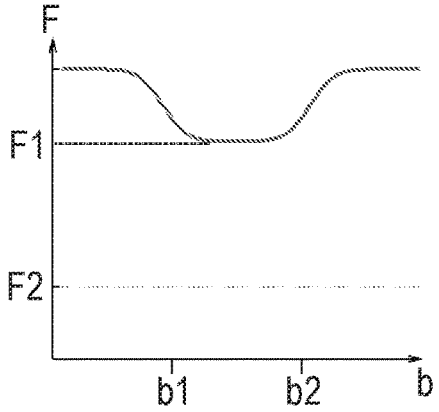
Figure 14D:
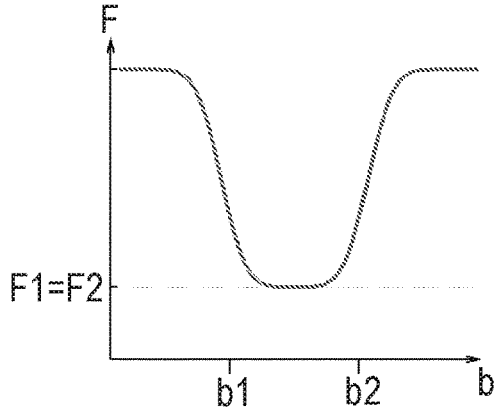

FIGS. 14C and 14D show modifications of the FIGS. 14A and 14B with a less sharp-edged transition of the residual moisture level F at the edges b=b1 and b=b2.

Figure 14E:
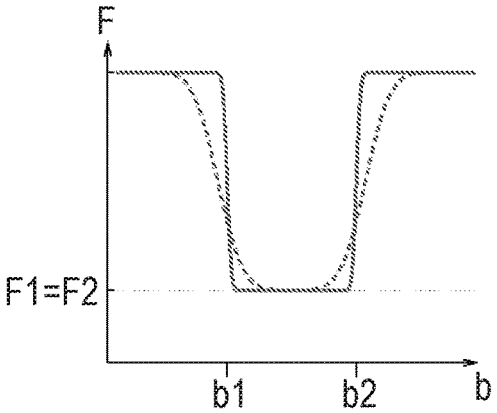

Finally, FIG. 14E shows a implementation in which the edge sharpness of the residual moisture level can be varied.

FIGS. 15A-15D show different implementations of drying units 1 for air drying.

Figure 15A:
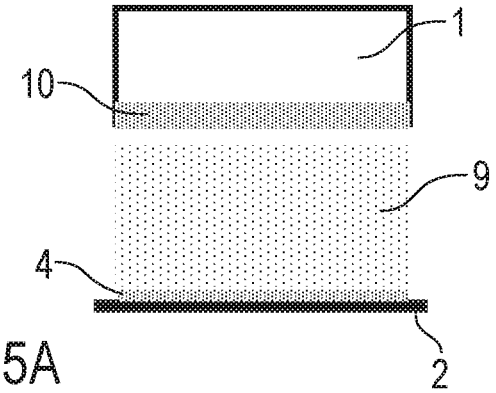

In the exemplary implementation according to FIG. 15A, the drying unit 1 emits an air stream 9 with a diffuser 10. The diffuser 10 therefore provides that the air stream 9 is diffuse.

Figure 15B:
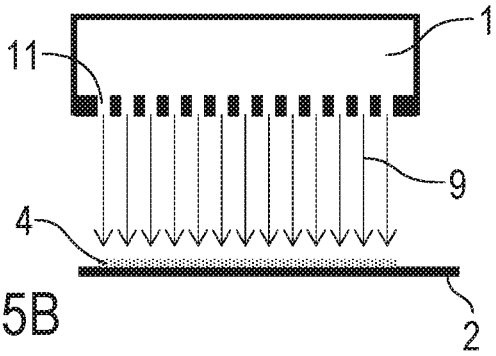

In the exemplary implementation according to FIG. 15B, however, the air stream 9 is emitted via numerous air nozzles 11, wherein the air nozzles 11 are oriented parallel to one another and perpendicularly to the surface of the component 2.

Figure 15C:
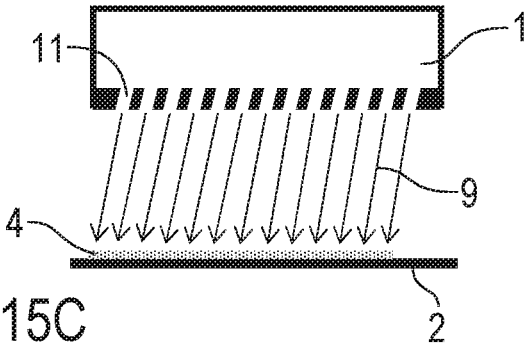

In the exemplary implementation according to FIG. 15C, however, the air nozzles 11 are oriented slightly obliquely to the surface of the component 2.

Figure 15D:
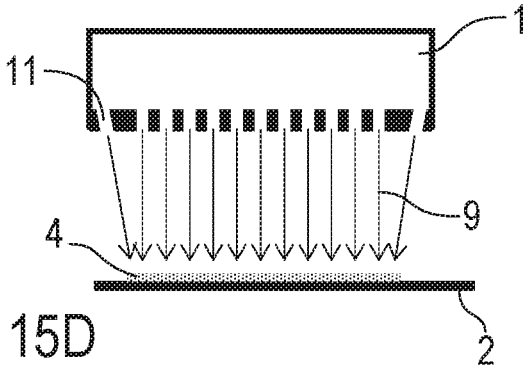

Finally, the air nozzles 11 in the exemplary implementation according to FIG. 15D are differently oriented. At the edge of the drying region, the air nozzles 11 are oriented obliquely inwardly. In the centre of the drying region, however, the air nozzles are oriented perpendicularly to the component surface.

Figure 16:
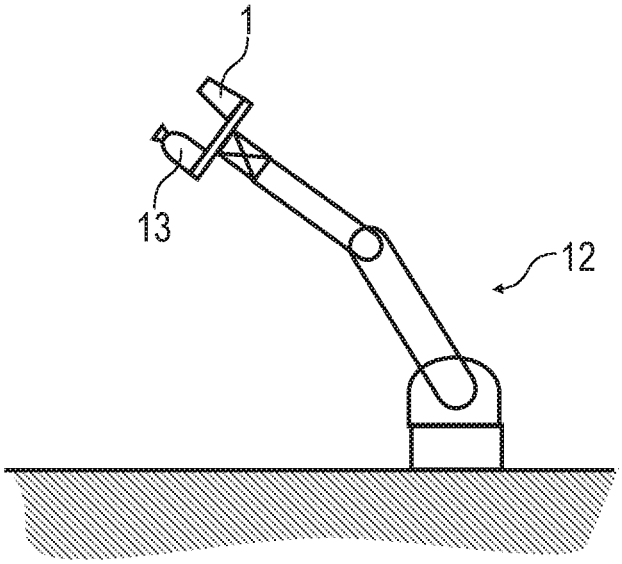

FIG. 16 shows a schematic representation of a painting robot 12 according to the present disclosure with a plurality of robot arms and a highly manoeuvrable robot hand axis, wherein the painting robot 12 carries both an applicator 13, e.g. of the aforementioned type, and also a drying unit 1. The applicator 13 serves herein to apply the decorative layer and can also be used to apply the base coat layer if no other applicator, for example, a rotary atomiser is to be used. The drying unit 1, by contrast, serves for limited area drying of the base coat layer or of the decorative layer.

Figure 17:
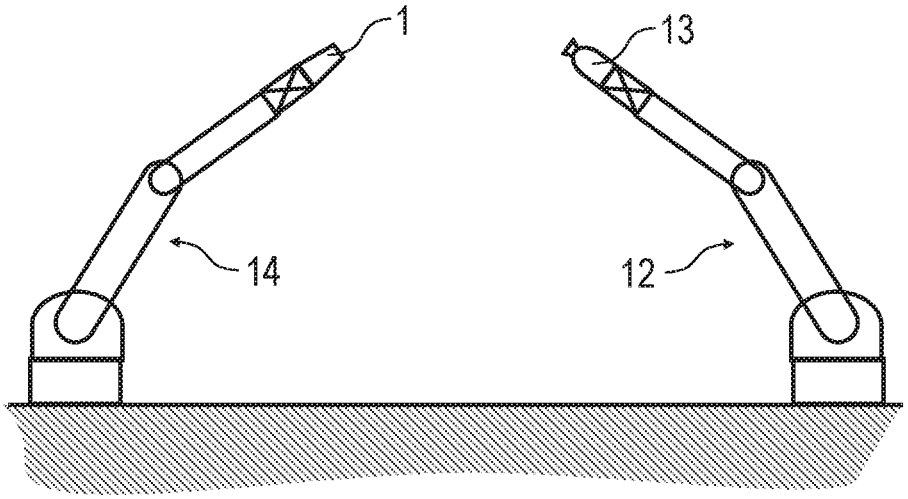

FIG. 17 shows a modification wherein the painting robot 12 carries only the applicator 13, whereas the drying unit 1 is guided by an additional multi-axis robot 14.

The present disclosure is not restricted to the above-described exemplary implementations. Rather, it should be understood that this disclosure is exemplary in nature, i.e. that additional variants and modifications are possible which also make use of the teachings of the present disclosure.

The invention claimed is:

1. A method for painting a component and providing a decorative layer, the component having an exterior, the method comprising:

applying a base coat layer onto the exterior of the component;

applying a paint layer onto the exterior of the component;

drying the exterior of the component before application of the decorative layer, applying the decorative layer onto the component in an overspray free manner without the use of a mask, the decorative layer defining a limited area decorative region smaller than the exterior region of the component;

drying a limited portion of the component using a robot having a drying unit at a drying region, the drying region at least partially encompassing the decorative layer, the drying region being smaller than the exterior region of the component, the drying region covering merely a peripheral edge of the decorative region, the drying region after drying the limited portion having a lower residual moisture level than a remainder of the decorative region; and applying a clear coat layer onto the paint layer and the decorative layer, including applying the clear coat layer to the drying region having the lower residual moisture level than the remainder of the decorative region and applying the clear coat layer to the remainder of the decorative region;

wherein the drying region covering the peripheral edge of the decorative region prevents running of the decorative region at the peripheral edge.

2. The method according to claim 1, wherein the drying region and the decorative region coincide areally.

3. The method according to claim 1, wherein the decorative region is larger than the drying region.

4. The method according to claim 1, wherein the paint layer is dried in an intermediate drying process to a first residual moisture level.

5. The method according to claim 1, wherein the drying of the limited portion of the component at the drying region includes, irradiating the component by electron bombardment.

6. The method according to claim 1, wherein the component is dried with a drying unit, and the drying unit is convex.

7. The method according to claim 6, wherein the drying unit is moved together with an applicator along a painting path over the component.

8. The method according to claim 7, wherein, while moving together on the painting path, the drying unit dries the component and the applicator applies the decorative layer.

9. The method according to claim 7, wherein the drying unit dries the component in a first movement over the painting path and the applicator applies the decorative layer in a second movement over the painting path.

10. The method according to claim 7, wherein the applicator applies the decorative layer in a first movement over the painting path and the drying unit dries the component in a second movement over the painting path.

11. The method according to claim 1 wherein the decorative layer is dried with a diffuser.

12. The method according to claim 1 wherein the drying of the limited portion is through radiation and a shield masks the exterior surface to only allow radiation to dry the decorative region.

13. The method according to claim 1 wherein the drying is directed through a diffuser.

14. The method according to claim 1 wherein the base coat is intermediate dried with air drying have a temperature between 60 Celsius and 80 Celsius.

15. A method for painting a component and providing a decorative layer, the component having an exterior, the method comprising:

applying a base coat layer onto the exterior of the component;

applying a paint layer onto the exterior of the component;

drying in a first drying operation only a drying region of the exterior of the component with a robot prior to an application of the decorative layer, the drying region defining a limited area smaller than the exterior of the component, the first drying operation using a robot, the first drying operation leaving a first residual moisture level;

applying the decorative layer onto the component in an overspray free manner without the use of a mask at the drying region, the decorative layer defining a limited area decorative region smaller than the exterior region of the component, the decorative layer being applied by the robot;

drying a limited portion of the component in a second drying operation, the limited portion covering merely a peripheral edge of the decorative region, the second drying operation leaving a second residual moisture level at the peripheral edge of the decorative region that is lower the first residual moisture level and lower than a moisture level at a remainder of the decorative region; and applying a clear coat layer onto the paint layer, the peripheral edge of the decorative region of the decorative layer having the second residual moisture level, and the remainder of the decorative region having the moisture level.

16. The method according to claim 15 wherein the base coat is dried.

17. The method according to claim 15, wherein the drying region and the decorative region coincide areally.

18. The method according to claim 15, wherein the decorative region is larger than the drying region.

* * * * *